US012780492B2

(12) United States Patent
Hoefte et al.

(10) Patent No.: US 12,780,492 B2
(45) **Date of Patent: *Nov. 3, 2026**

(54) CONTAINER WITH SUPPORT ELEMENT

(71) Applicant: The Procter & Gamble Company, Cincinnati, OH (US)

(72) Inventors: Paulus Antonius Augustinus Hoefte, Astene (BE); Joseph Bohache, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 235 days.

This patent is subject to a terminal disclaimer.

(21) Appl. No.: 18/592,632

(22) Filed: Mar. 1, 2024

(65) Prior Publication Data

US 2024/0294301 A1 Sep. 5, 2024

(30) Foreign Application Priority Data

Mar. 2, 2023 (EP) ..... 23159560

(51) Int. Cl.
*B65D 5/68* (2006.01)

(52) U.S. Cl.
CPC ..... *B65D 5/685* (2013.01)

(58) Field of Classification Search
CPC .... B65D 5/441; B65D 5/445; B65D 5/48028; B65D 5/68–685; B65D 5/6608;
(Continued)

(56) References Cited

U.S. PATENT DOCUMENTS 1,130,271 A * 3/1915 Hammond ..... B65D 5/685 206/815
1,664,308 A * 3/1928 Miller ..... B65D 5/4295 119/490

(Continued)

FOREIGN PATENT DOCUMENTS

EP 3936450 A1 1/2022
EP 4039604 A1 8/2022
GB 2472257 A * 2/2011 ..... B65D 5/006

OTHER PUBLICATIONS

EPO Search Report and Opinion for Application No. 24160881.9 ; dated Jun. 24, 2024, 09 pages.

(Continued)

*Primary Examiner* — Scott T McNurlen
(74) *Attorney, Agent, or Firm* — Abigail O. Idokogi; Gary J. Foose

(57) ABSTRACT

Examples include a cardboard or paperboard container comprising a box, a lid and a lock. The lock comprises an actuator moveable from a locking to an opening position by applying an actuation pressure. The lid comprises a support element fitting within the box when the lid is closed. The support element comprises a first and a second primary panel corresponding to faces of a first prism connected to the top of the lid. The support element further comprises a third and a fourth primary panel corresponding to faces of a second prism connected to the top of the lid. The first and the second prisms are offset along a direction parallel to the top of the lid, the prisms each having a length such that a sidewall of the box comes into contact with at least part of either or both prisms as the actuation pressure is applied.

16 Claims, 7 Drawing Sheets

(58) Field of Classification Search
CPC ..... B65D 5/38; B65D 5/4608; B65D 5/2025; B65D 5/22; B65D 5/541
USPC .... 229/919, 122.32, 122.34, 125.26, 125.28, 229/125.19, 125.29
See application file for complete search history.

(56) References Cited

U.S. PATENT DOCUMENTS

| | | | | | |
|---|---|---|---|---|---|
| 2,032,799 | A * | 3/1936 | Hagopian | B65D 85/34 | 217/3 BC |
| 3,159,326 | A * | 12/1964 | Stonebanks | B65D 5/441 | 220/639 |
| 4,948,033 | A * | 8/1990 | Halsell, II | B65D 5/445 | 229/117.16 |
| 5,205,477 | A * | 4/1993 | Zimmermann | B65D 5/685 | 229/125.26 |
| 5,450,998 | A * | 9/1995 | Esse | B65D 5/32 | 229/122.34 |
| 6,105,855 | A * | 8/2000 | Kackstetter | B65D 5/685 | 229/117.07 |
| 11,794,947 | B2 * | 10/2023 | Hoefte | B65D 5/445 | |
| 11,859,687 | B2 | 1/2024 | Ziegler | | |
| 12,139,311 | B2 * | 11/2024 | Hoefte | B65D 5/445 | |
| 2003/0168502 | A1 * | 9/2003 | Kisch | B65D 5/323 | 229/120.34 |
| 2013/0037432 | A1 * | 2/2013 | Chang | B65D 5/4608 | 220/651 |
| 2021/0047072 | A1 | 2/2021 | Ng Pak Leung et al. | | |
| 2021/0347524 | A1 | 11/2021 | Hoefte et al. | | |
| 2022/0185534 | A1 | 6/2022 | Hoefte et al. | | |
| 2022/0289436 | A1 | 9/2022 | Hoefte et al. | | |
| 2022/0380086 | A1 | 12/2022 | Hoefte et al. | | |
| 2023/0103439 | A1 | 4/2023 | Hoefte et al. | | |
| 2023/0110630 | A1 | 4/2023 | Hoefte et al. | | |
| 2023/0132541 | A1 | 5/2023 | Hoefte et al. | | |
| 2023/0257141 | A1 | 8/2023 | Ruers et al. | | |
| 2023/0257145 | A1 | 8/2023 | Ruers et al. | | |
| 2023/0264852 | A1 | 8/2023 | Hoefte et al. | | |
| 2023/0264853 | A1 | 8/2023 | Hoefte et al. | | |
| 2023/0286695 | A1 | 9/2023 | Hoefte et al. | | |
| 2023/0322455 | A1 | 10/2023 | Beelen et al. | | |
| 2023/0331447 | A1 | 10/2023 | Hoefte et al. | | |
| 2024/0002100 | A1 | 1/2024 | Hoefte et al. | | |
| 2024/0076074 | A1 | 3/2024 | Ruers | | |

OTHER PUBLICATIONS

PCT Search Report and Written Opinion for PCT/US2024/017964 dated Jun. 5, 2024; 14 pages.
Extended EP Search Report and Search Opinion for 23159560.4 dated Aug. 28, 2023, 9 pages.

* cited by examiner

CONTAINER WITH SUPPORT ELEMENT

BACKGROUND OF THE INVENTION

This invention generally relates to packaging using cardboard or paperboard material. Cardboard or paperboard are widely used packaging material which are particularly suited for recycling, in particular recycling in a paper recycling stream which may involve a reduced non fiber content, for example a maximum non fiber content of 5% by weight, and thereby particularly environmentally friendly. Cardboard or paperboard however have limitations compared to other packaging materials such as plastic materials, in particular as far as mechanical characteristics are concerned.

DETAILED DESCRIPTION OF THE INVENTION

Figure 1:
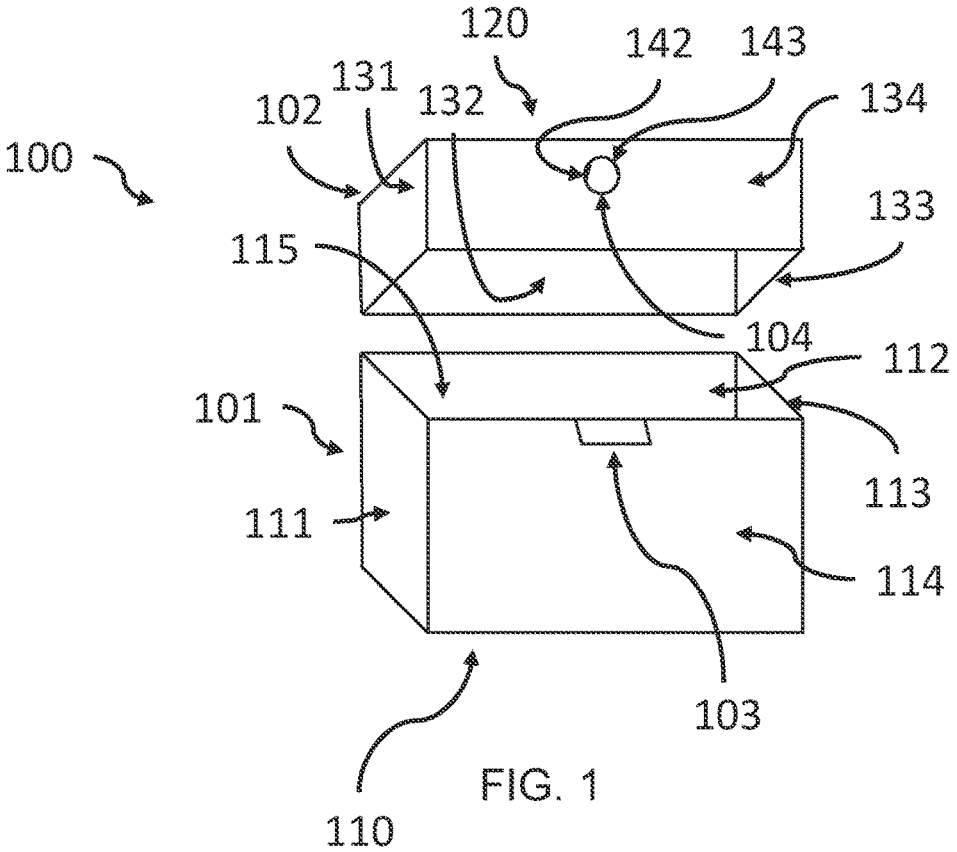
FIG. 1 illustrates a first example container.

This disclosure focuses on providing a cardboard or paperboard container comprising a box, a lid for the box, and a lock to maintain the lid in a closed position, the lock being operated by application of an actuation pressure which may distort the structure of the container due to the natural flexibility of cardboard or paperboard material. Such distortion may be reduced or prevented by providing the lid with a support element fitting within the box when the lid is in a closed position, whereby the actuation pressure gets exerted through lid flanks and box sidewalls onto such support element, avoiding an excessive distortion of such flanks and sidewalls. While increasing structural integrity, such a support element may however reduce available storage space in the box, in particular by reducing a headspace. Examples provided in this disclosure provide such structural integrity while permitting reducing an impact on headspace and increasing reliability.

Cardboard or paperboard is, mechanically speaking, a relatively flexible material, meaning that a wall of a container made of cardboard or paperboard may offer little resistance to getting bent under an external pressure. In some applications where resistance to getting bent and/or high tear resistance is of importance, a material different from cardboard or paperboard may be used. Materials different from cardboard or paperboard may however not be as straightforward to recycle. Such choice of material thereby results of a compromise. An objective of the present disclosure is to propose a cardboard or paperboard container structure permitting use of cardboard or paperboard in applications which would otherwise be compromised by using another material.

As the container according to this description may be shaped using folding machinery which is likely to be already in place at a manufacturing location, little or no additional capital may be required at a manufacturing location to implement the structures according to this disclosure.

A cardboard or paperboard container according to this disclosure may be made from paper material wherein the paper material is for example selected from paperboard, multiple layer cardboard, or laminates comprising at least one paperboard or cardboard layer. Cardboard or paperboard should be understood as material comprises cellulose fibre materials or a mixture thereof. The material used to make the lid, box or the entire container may comprise other ingredients in addition to cardboard or paperboard, such as colorants, protective varnishes, surface enhancement coatings, barrier coatings, preservatives, recycled fibre materials, plasticisers, UV stabilizers, oxygen barriers, perfume barriers, and moisture barriers, or a mixture thereof. In some examples, in order to provide a desired tear resistance and strength, the average cellulose fibres length is in a range from 0.1 to 5 mm, preferably from 1 to 3 mm. In some examples, cellulose fibres are sourced from various sources such as virgin soft or hard woods, hemp, grass, corn, bagasse, sugarcane, bamboo and others, and/or from post producer or post consumer recycled paper and cardboard.

The lid, box or container may comprise areas of external or internal printing. The lid, box or container may be made for example by cardboard making. Suitable lid, box or container manufacturing processes may include, but are not limited to, tube forming from a flat cardboard or paperboard sheet with a gluing step, folding, or a mixture thereof. The lid, box or container may be opaque or filter some specific wavelengths, for example to protect content from external light. In some examples the lid, box or container is constructed at least in part and in some specific examples in its entirety from paper-based material. By paper-based material, we herein mean a material comprising paper. Without wishing to be bound by theory, by 'paper' we herein mean a material made from a cellulose-based pulp. Paperboard may be made from a paper-based material having a thickness and rigidity such that it does not collapse under its own weight. While paperboard may comprise a single layer of material, cardboard may comprise a plurality of paper-based material layers. In some examples, cardboard comprises paperboard, corrugated fiber-board, or a mixture thereof. Corrugated fiber-board comprises a series of flutes. Each flute can be understood to be a channel. The flutes run parallel to one another, with the flute direction being the direction travelled along each channel. The paper-based material may be a laminate comprising paper, paperboard, corrugated fiber-board, or a mixture thereof, and in some examples at least another material. In some examples, the at least another material comprises a plastic material. In some examples, the plastic material comprises polyethylene, more specifically Low Density PolyEthylene (LDPE), polyethylene terephthalate, polypropylene, polyvinylalcohol or a mixture thereof. In some examples the plastic material comprises a copolymer from an ethylene starting monomer and vinyl alcohol, or EVOH. A barrier material may be used as the at least another material. The barrier material may be a biaxially orientated polypropylene, a metallised polyethylene terephthalate, or a mixture thereof. The at least another material may comprise a wax, a cellulose material, polyvinylalcohol, silica dioxide, casein based materials, or a mixture thereof. In some examples, the paper-based laminate comprises greater than 50%, preferably greater than 85%, and more preferably greater than 95% by weight of the paper based laminate of fiber-based materials. In some examples, the barrier material may comprise plastic material having a thickness of between 10 micron and 60 micron. In some examples, the barrier material may comprise plastic material having a thickness of between 10 micron and 35 micron. The paper-based material may be a laminate. In specific examples, cardboard comprises paperboard, corrugated fiber-board and lamination of polyethylene, especially LDPE, or a mixture thereof, and, in some examples, the external surface of the lid, box or container or a combination thereof comprises the at least another material. Alternatively, the at least another material might also be laminated in-between two paper-based material layers such as paperboard or cardboard layers as per this disclosure. Without wishing to be bound by theory this at least another material might act as a barrier for leaked liquid absorbed by the paper-based material facing the interior side of the lid, box or container, to prevent or reduce a contaminating flow through a wall of the lid, box or carboard container. Other structures may be found efficient to avoid leakage from the content or to protect the content from external fluids, for example from a shower, a sink, or by handling the container or the lid with wet hands. Contamination of a wall of the lid, box or container might be unsightly to consumers or may contaminate the storage area. In some examples, the lid, box or container are made of a paper-based material comprising the at least another material laminated in between two corrugated fiberboard layers. In some examples, the material used for the lid, box or container comprises a core cardboard flute material sandwiched between two plain cardboard (or paperboard) layers and polyethylene laminate. A paperboard or cardboard layer according to this disclosure may be made from or comprise recycled material or recycled cellulose fibres. The external surface of the lid, box or container may comprise a coating or a varnish. Such a coating or varnish can help making a board repellent to water or help protecting a content such as an enclosed detergent composition from UV light. The coating or varnish could also help protecting the external surface of the lid, box or container from being contaminated by the content, for example an enclosed detergent composition, for example if leakage of a water-soluble unit dose detergent enclosing a liquid detergent composition would occur.

A coating or vanish on the internal surface can help to prevent the content to stick to the inner surface or prevent migration of inks, colorants, perfumes, non-ionics, oils, greases and other ingredients from the content into the board or inks or additives from the board onto the content. In some examples detergent resistant varnishes or coatings can be applied on areas exposed to the contents.

FIG. 1 illustrates an example cardboard or paperboard container 100. Containers according to this disclosure may take numerous shapes. In an example, the container is a generally cubical container, such cubical container 100 comprising a box 101, a lid 102 for the box, and a lock 103 to maintain the lid in a closed position.

As illustrated for example in FIG. 1, an example container should be understood in this disclosure as an object for housing a content, for example in a cavity of the container. The container facilitates protection, transport, storage, access and disposal of a content, such as a consumer product. In this example, the container comprises the box 101. A box should be in this disclosure understood for example as a generally parallelepiped, barrel shaped, cylindrical, cubical, partially round or partially oval three-dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure may contain for example a detergent product, but could contain other products, in particular other moisture sensitive products. The box according to this disclosure comprises a base 110, sidewalls 111-114 and an opening 115. A base according to this disclosure should be understood as a surface on which the box may lie when placed on a supporting surface such as a shelf or a floor, the opening 115 facing up and the base 110 facing down when in position of use, in order to maintain content in the box by gravity. The opening should thereby be understood as opposite to the base. In some examples, the base is flat. In some examples, the base is rectangular. In some examples, the base is oval or round. In some examples, the base has an embossed profile standing in or out in relief. The sidewalls according to this disclosure should be understood as extending from the base, and connecting the base to the opening or to a transition piece. It should be understood that the connection of the base to the opening may include a transition piece in addition to a sidewall. A transition piece may be glued or otherwise attached to the sidewall for example. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples, sidewalls have a shape corresponding to one of a square, a rectangle, a trapeze, a section of a sphere, a section of an ovoid, or a section of an ellipsoid. The opening according to this disclosure should be understood as an aperture providing access to a content such as, for example, a detergent product contained in the box. In some examples, the opening has a surface of less than the surface of the base. In some examples, the opening has a surface larger than the surface of the base in order to provide an improved access, for example using sidewalls extending from the base at an angle of more than 90 degrees from the base. In some examples, the opening is provided after removal of a tamper proof feature, for example comprising a perforated piece to be removed at first use or a tamper evident sticker locking the lid to the box or tray. In some examples, the opening is placed on a top panel of the box, the top panel of the box facing the base of the box, the top panel of the box being separated from the base of the box by at least the sidewalls, the top panel of the box being generally coplanar with the base of the box, whereby the opening covers a portion of the top panel, the top panel comprising a peripheral section surrounding the opening, the peripheral section being a transition piece between a sidewall and the opening for example. In some examples, the opening is rectangular. In some examples, the opening is rectangular with rounded edges. In some examples, the opening comprises round or oval sections. The lid according to this disclosure should be understood as a removable element permitting to repeatedly close or open the opening of the container. The lid may be separated from the box in order to provide access to a content of the box. The lid according to this disclosure comprises a top such as top 120 for example, and flanks such as flanks 131-134 for example. Lid 102 is separately illustrated in FIG. 2 in an upside down position in order to illustrate the insides of the lid which will be described here. It should be understood that the top of the lid is aimed at covering the opening of the box when the lid is in a closed position. In some examples, the top of the lid is rectangular. In some examples the top of the lid is polygonal, for example triangular, rectangular, square, hexagonal or octagonal. The top of the lid may also comprise round or oval sections. In some examples, the lid comprises beveled edges. The lid comprises flanks 131-134. It should be understood that the flanks according to this disclosure are elements connected to the top 120 of the lid and extending from the lid in order to engage one or more sidewalls of the box. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flankless. The top of the lid covers the opening, and the flanks cover at least a specific portion of sidewall of the box when the lid is in the closed position, the lid being moveable from the closed position to an open position. The box and lid cooperate to participate in fulfilling the role of the container to store, transport, protect and facilitate access to a content of the container.

The container according to this disclosure comprises a lock such as lock 103. A lock should be in this disclosure understood as a mechanism preventing or reducing the likelihood of an accidental opening. The lock according to this disclosure is to maintain the lid in a closed position. It should be understood that the lock according to this disclosure is expected to function under normal use of the container. It should be understood that the lock may not fulfill its function when for example an unusual use is made of the box, or when the box is under unusual conditions. The lock comprises at least a first actuator 103 moveable from a locking position to an opening position by applying an actuation pressure onto the actuator when the lid is in the closed position. The actuator should be understood in such examples as a mechanical structure submitted to a movement upon actuation by an outside force or actuation pressure, such movement leading to the opening of the lock when such movement takes place. In some examples, the actuator according to such examples is resilient and has a default position, such default position corresponding to the lid remaining closed, the resilience being vanquished by an outside force or actuation pressure in order to open the lid. In some examples, the actuator is resilient in that the actuator comprises a flexible element 103, the flexible element having a default position corresponding to the lid remaining closed, the flexible element being pressed to open the lid, the flexible element springing back to the default position when releasing pressure. It should be understood that a pressure is generated by the application of a force onto a surface. The actuator according to such examples has at least two positions being an opening position and a locking position, whereby the opening position corresponds to a position permitting opening of the lid, the locking position preventing opening of the lid or reducing the possibility of an accidental opening of the lid, for example while manipulating the container and holding the container by the lid.

The first actuator is connected to a specific portion of sidewalls of the box, which is a specific portion covered by at least a portion of the flanks when the lid is in the closed position. The first specific portion of sidewall and the first actuator pertain to a same specific sidewall. In some examples, the actuator abuts against a locking tab or abutment tab of the flanks when in the locking position, the actuator being maintained away from the locking tab when in the opening position, the actuator being displaceable by the actuation pressure by an unlocking displacement distance in a direction normal to the specific portion of the sidewalls. The connection of the actuator to the specific portion of the sidewall is due to the actuator participating in locking or unlocking the specific portion of the sidewall from the portion of the flanks covering the specific portion of the sidewall, thereby permitting releasing the lid from the box. The flanks may comprise a locking tab, or abutment tab, for example formed by an internal paperboard or cardboard layer. A locking tab should be understood as a mechanical element which interlocks with the actuator. In some examples the locking tab extends away from the flanks towards a sidewall of the box and may be in the form of a bulge, a ridge, an embossment or an additional material layer sticking out of the flanks of the lid and towards the specific portion of the side wall such that the actuator may abut against the tab when in the locking position to prevent separating the specific portion of the sidewalls from the flank in the area of the actuator. In some examples, the locking tab is comprised in the flank itself. Abutment should be understood as a contact between the actuator or part of the actuator and the tab, such contact preventing opening of the lid. In some examples the actuator is maintained away from the locking tab when in the opening position, in order to release the locking tab. Such release of the locking tab permits opening the lid. Displacement or movement of the actuator from the locking to the opening position is by application on the actuator (directly or indirectly) of an actuation pressure or force such that the actuator is displaced by a distance sufficient to suppress contact of the actuator with the locking tab, such distance corresponding to the displacement distance, in a direction normal to the specific portion of the side wall. It should be understood that the force or pressure leading to the displacement may have a number of different directions, such different directions contributing to the displacement if a component of such force or pressure is in a direction normal to the specific portion of the side wall. Such force or pressure may also comprise a component which may be parallel to the side wall. The actuation is however triggered by a component of such force or pressure being normal to the specific portion of side wall. Such presence of a component normal to the specific portion of sidewall participates in the role of the lock of avoiding an accidental opening by lifting the container through lifting the lid by applying a force parallel to the sidewall and away from the base, whereas desired opening would take place by the consumer "pushing" the actuator and applying the unlocking force or pressure permitting opening of the lid while lifting the lid. In other words, while a consumer may apply a force on the actuator along a direction which may not be normal to the sidewall, if a component of such force is normal to the sidewall such component may participate in applying the pressure leading to the displacement of the actuator. In some examples such a lock would participate in suppressing or reducing the risk of accidental opening of the lid while permitting desired opening by a consumer, the functioning of such a lock depending in some examples on ensuring that the actuator maintains abutting against the locking tab even in case of pulling strongly on the lid in a direction parallel to the side wall in order to transport or lift the consumer product. The avoidance or reduction of the risk of accidental opening would also apply to a force being applied in a direction parallel to the sidewalls for example by friction with another box located side to side with a box according to this disclosure, or by a box falling over during transportation, or by internal movements of the content of the box pushing the lid during transportation.

In some examples, the lock is placed in a central area of a sidewall of the box. A central area should be understood as substantially equidistant from opposite edges of the sidewall concerned, such edges being along a direction normal to the base of the box. In such examples, it should be understood that the lock is located closer to an extremity of the sidewall close to the opening than to an extremity of the sidewall close to the base, while being in a central area in respect to the edges normal to the base. In some examples, the lock may be located on a sidewall and between two edges of the sidewall, such edges being normal to the base, the lock being closer to one edge than to the other edge of the two edges, for example located closer to the one edge at a ⅓ of the distance between the two edges. In some examples one sidewall may comprise two or more locks.

The content of a container according to this disclosure, such as a consumer product, for example a detergent product, are products which may be relatively heavy, in particular when the container is recently acquired and thereby holds a significant quantity of product. While some consumers may lift and transport such a container carefully by supporting the base of the box, such lifting and transport may also occur by holding such consumer product by the lid, in particular by holding distal ends of lid flanks away from the top of the lid, without holding the base. Some consumers may even hold the container by inserting fingers between lid flanks and box sidewalls. In such cases, it is possible that the lid, submitted to the force of gravity of the content of the container, be submitted to tension or even to rupture of the lid, leading to accidental opening of the box, the box falling and possibly spreading its content. Such situations should be avoided. Beyond avoiding such unintentional release, the structure of the container should preserve or improve opening ergonomics and prevent or reduce a structural deformation upon excessive or repetitive application of forces applied to the container, for example during transport, in a grocery shopping bag against other objects, when submitted to external pressure, or when dropped, or to be durable to withstand multiple opening and reclosing cycles in use. At the same time, containers may be elaborated in order to preserve the environment. The container according to this disclosure aims at taking these different aspects into account.

In order to provide precision in locating a finger appropriately in order to unlock the lock, the flanks comprise a first tactile discontinuity, such as tactile discontinuity 104, for example in the form of an actuation area in a specific flank. The first tactile discontinuity faces the first actuator when the lid is in the closed position. The fact that such tactile discontinuity faces the actuator indeed permits locating either the thumb or one or more of the other fingers on exactly the area on which a lock opening force, or actuation pressure, should be applied. The tactile discontinuity should be understood as defining a localised discontinuity on a flank, whereby a user or consumer may perceive such discontinuity in order to correctly locate the thumb or one or more other fingers. Such discontinuity may comprise one or more of an actuation aperture, an actuation flap, an actuation slit, an actuation membrane, or tactile elements comprised in or applied to a surface of the flank such as embossments, debossments, surface texturing, buttons or the like. In some examples, the tactile discontinuity or the specific portion comprises a visual indication indicating the location of the tactile discontinuity. In some examples whereby the tactile discontinuity is an aperture or is transparent or translucent, the specific portion comprises a visual indication visible through the tactile discontinuity when the lid is closed. The visual indication may be printed on an external surface of the side wall or flanks and may comprise one or more arrows or one or more areas printed in a striking colour or a specific text providing instructions such as "push here to open" for example, or a combination of any of these indications. The tactile discontinuity is configured to permit displacing an actuator from the locking position to the opening position by applying the actuation pressure at the tactile discontinuity when the lid is in the closed position, if it does not directly face a sidewall. In order to appropriately place the thumb or one or more other fingers, the tactile discontinuity can span less than 8 $cm^2$ and more than 0.2 $cm^2$. It was found that a larger area would lead to lack of precision in finger placement, and that a smaller area would lead to the actuation area being difficult to locate for a user or consumer. In some examples (such as FIG. 1, 2, 3A, 3B, or 3F) the tactile discontinuity has a circular shape in order to ease positioning. Other shapes may be considered such as, for example, elliptical (see FIG. 3C), oval, square, rectangle (see FIG. 3E), triangular, square with rounded corners (see FIG. 3G), triangular with rounded corners, other polygonal shapes (see FIG. 3H) or other polygonal shapes with rounded corners (see FIG. 3D).

The lid further comprises a support element 140 fitting within the box when the lid is in a closed position. It should be understood that the support element enters the opening of the box when the lid is in the closed position. In some examples, at least part of the specific portion of the sidewalls is located, or sandwiched, between the flanks and the support element when the lid is in the closed position, a clearance distance separating the sidewall from the support element structure in a direction normal to the specific portion of the sidewalls when the lid is in the closed position and when no actuation pressure is applied, the clearance distance being reduced to zero by flexing of the specific portion of the sidewalls when the actuation pressure is applied above a pressure threshold when the lid is in the closed position. While the clearance distance according to this disclosure is considered in a region of the lock, the tolerance distance between the lid and the box may be considered along an entire perimeter of the opening of the box. In some examples, the tolerance is of at least 0.1 mm and of less than 5 mm. In some examples the tolerance is of at least 0.5 mm and of less than 3 mm. Such tolerance would for example be measured when the lid is in the closed position and between an internal surface of the flanks and an external surface of the sidewalls, understanding that such tolerance may take a different value in a region of the closed lock. Both the support element and the flanks are structurally part of the lid, the support element and the flanks permitting sandwiching the specific portion of the sidewall, thereby preventing sinking in of the specific portion of the sidewall and undesired disengagement of the actuator. It is important to take note of the fact that in case of an actuation pressure being applied while lifting the box by holding the lid, the pressure applied will catch the sandwiched specific portion of the sidewall against the support element structure, thereby compensating a force of gravity which may otherwise disconnect the lid from the box, such compensation of the gravity force being through a resisting static friction force between the specific portion of the sidewall and the support element. In some examples, the use of the support element permits using for making the box a relatively flexible material, whereby such flexible material would flex in the absence of the support element structure to the point that the box would fall off if lifted by its lid. Permitting using a relatively flexible material also permits using a lesser quantity of such material due to the presence of the support element which compensates for such flexibility. The presence of such support element thereby prevents or reduces the risk of accidental opening even if the actuation pressure is applied onto the actuator of the lock, for example as the box is lifted while applying pressure on the actuator of the lock.

The support element according to this disclosure comprises a first primary panel 141 and a second primary panel 142 connected by a first linear ridge 151 parallel to a transverse direction T (see for example FIG. 2) normal to the specific side wall, the first primary panel and the second primary panel corresponding to faces of a first prism connected to the top of the lid, the first linear ridge corresponding to an edge of the first prism. The support element further comprises a third primary panel 143 and a fourth primary panel 144 connected by a second linear ridge 152 parallel to the transverse direction, the third primary panel and the fourth primary panel corresponding to faces of a second prism connected to the top of the lid, the second linear ridge corresponding to an edge of the second prism. The first and the second prisms are offset along a direction P parallel to the top of the lid, the prisms each having a length along the transverse direction such that at least part of the first specific portion of sidewall comes into contact with at least part of either or both prisms as the actuation pressure is applied. One should note that such direction P is also perpendicular to the linear ridges.

This specific support element structure comprising at least two such prisms was found to provide a number of combined advantages. A first advantage is that the use of at least two prisms connected to the top provides a reliable anchoring of the support element to the top of the lid, providing a robust structure. Another advantage is that the coverage of the support element may be relatively broad along a direction P parallel to the top of the lid while limiting a depth which the support element would reach within the box when the lid is closed (in the example of FIGS. 1 and 2, such depth would correspond to distances between, on one end, the linear ridges 151 or 152 and, on the other end, the top of the lid), thereby avoiding or reducing the possibility of pushing the support element into a content of the box when closing the lid. Such a structure also offers a multiplication of panels which may be used to come into contact with the first specific portion of sidewall, thereby providing flexibility as to placement of the first actuator or first tactile discontinuity, thereby reducing manufacturing constraints. More generally speaking, such structure provides support across a broader region along a direction P parallel to the top of the lid, avoiding or reducing risks of container distortion across such broader region, for example due to grabbing of the lid by a consumer or by grabbing the box by its base while pressuring the sidewalls between the thumb and other fingers. Sidewall distortion may also result from an alternative item pressing against any of such walls during storage or transport. An accidental opening of the container as a consequence of wall distortion may be prevented by the support provided by the two prisms.

Figure 2:
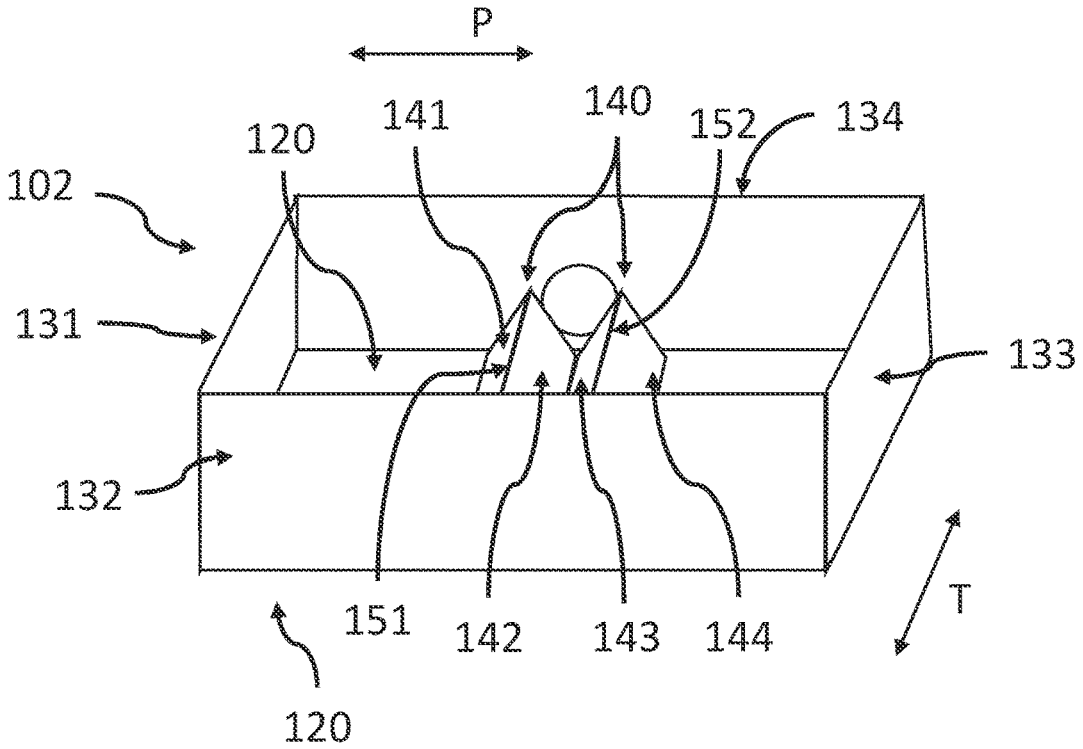
FIG. 2 illustrates a lid of the first example container.
Figure 3A:
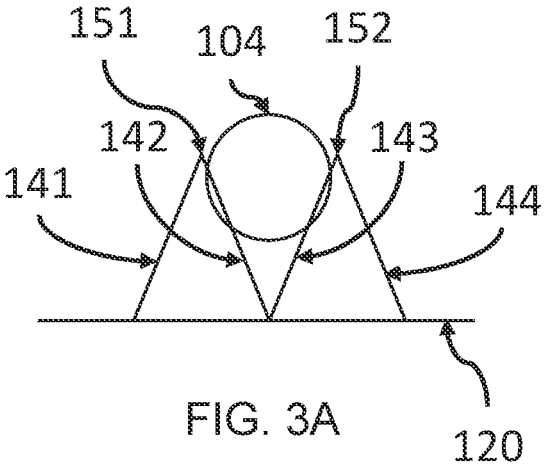
FIG. 3A-H illustrate different example lid configurations.
Figure 3B:
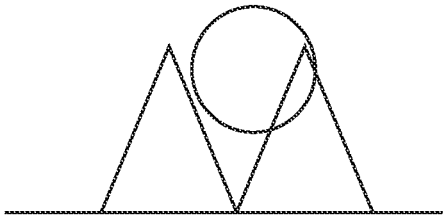
Figure 3C:
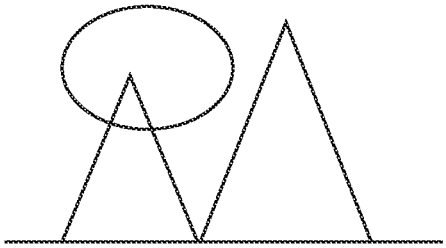
Figure 3D:
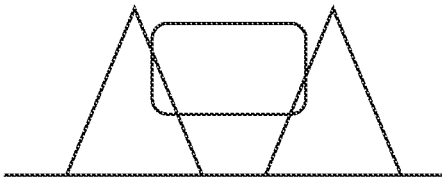
Figure 3E:
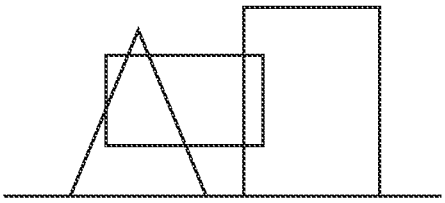
Figure 3F:
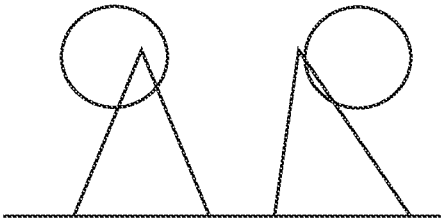
Figure 3G:
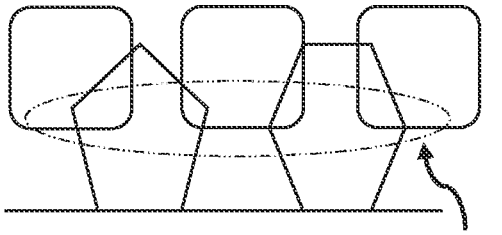
Figure 3H:
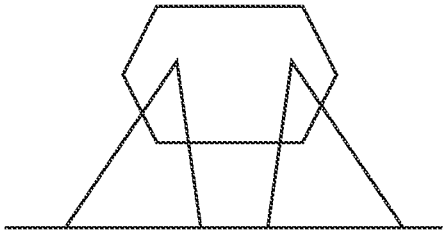

FIGS. 3A-H schematically illustrate different prism configurations according to examples of this disclosure, represented as views along a plane normal to the linear ridges, the lid being upside down as represented for example in FIG. 2. FIG. 3A for example represents the configuration of FIGS. 1 and 2, whereby the top 120 of the lid is connected to a first prism comprising first primary panel 141 and second primary panel 142, and connected to a second prism comprising third primary panel 143 and fourth primary panel 144. In the configuration of FIG. 3A, the prisms have a triangular cross section along a plane normal to the linear ridges, each prism being formed from two primary panels and from a respective portion of the top of the lid. In the configuration of FIG. 3A, the first tactile discontinuity is a generally circular aperture. In the configuration of FIG. 3A, the first tactile discontinuity intersects both the second and the third primary panels, such that the first specific portion of sidewall comes into contact with both prisms as the actuation pressure is applied. This is also visible in FIGS. 1 and 2. A similar but different configuration is illustrated in FIG. 3B. One should note that the reference numerals in FIGS. 3A-H are not used on each Figure in order to maintain readability. The configuration illustrated in FIG. 3B only differs from FIG. 3A in the relative positioning of the first tactile discontinuity, whereby such first tactile discontinuity is slightly offset along a direction parallel to the top of the lid. Such slight offset may be the result of a design change, may be the result of manufacturing imprecision or tolerances, or may be the result of a slight lid distortion due to lid use. As illustrated, the position shift between the configuration 3A and the configuration 3B results in a change from the first specific portion of sidewall coming into contact, in FIG. 3A, with both prisms as the actuation pressure is applied, to the first specific portion of sidewall coming into contact, in FIG. 3B, with a single one (in this case the second prism) of both prisms as the actuation pressure is applied. As illustrated, the configuration according to this disclosure provides support across a broad region along a direction parallel to the top of the lid as explained above.

In the configurations illustrated in FIGS. 1, 2, 3A and 3B, the primary panels 141-144 have a same size, in this specific example a same rectangular size. This configuration may for example provide a relatively homogeneous support configuration whereby the linear ridges 151 and 152 are provided at a same height. In some examples, the lid is symmetrical (see for example FIG. 3A, 3B, 3D, 3H, 6A, 7D, 7E, 7G or 7H), whereby a plane of symmetry of the lid is perpendicular to the top of the lid and perpendicular to the first specific portion of sidewall, thereby permitting a reversible lid placement. A symmetrical lid may comprise additional and/or further tactile discontinuities as will be described in more detail below. Some configurations may be considered using primary panels having different sizes such as, for example, the configurations according to FIG. 3C, 3F or 3H. Such asymmetrical configurations can provide for a customization of the support, which could for example reflect an asymmetrical use which may take into account that a lid may be expected to be used with, for example, a right hand, the thumb being placed on one side of the lid, the other fingers on another side, the thumb being expected to face the index (the first tactile discontinuity of FIG. 3C for example being located between the thumb and index), the support being extended in the region of the lid expected to correspond to the positioning of the middle, ring and little fingers (in FIG. 3C, such support extension corresponding to the larger prism for example). Other examples of customizations may be considered. In some examples, the second and third primary panels have a same first size, and the first and fourth primary panels have a same second size differing from the first size as illustrated for example in FIG. 3H.

One should note that different prism types may be used beyond the triangular prism, as illustrated for example in FIG. 3E or 3G. Use of different prism types provide for support customization. The asymmetrical configuration related to finger positioning explained in the context of FIG. 3C may also for example be obtained by a configuration as per FIG. 3E, whereby a second prim has a rectangular cross section corresponding to a region expected to correspond to the positioning of the middle, ring and little fingers of a user. Other examples comprise prisms having a pentagonal or hexagonal cross section as illustrated on FIG. 3G. Other polygonal configurations may be considered in line with a desired support configuration. In the example of FIG. 3G, such customization may broaden support in a region 301 generally corresponding to a center of the prisms, such region for example corresponding to an expected positioning of fingers. FIGS. 3F and 3G show configurations comprising a plurality of tactile discontinuities which will be discussed in more details below.

Figure 4:
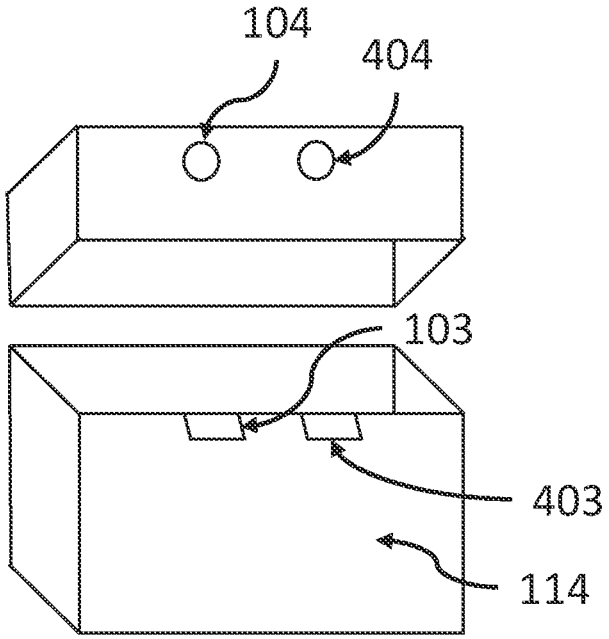
FIG. 4 illustrates a second example container.
Figure 5:
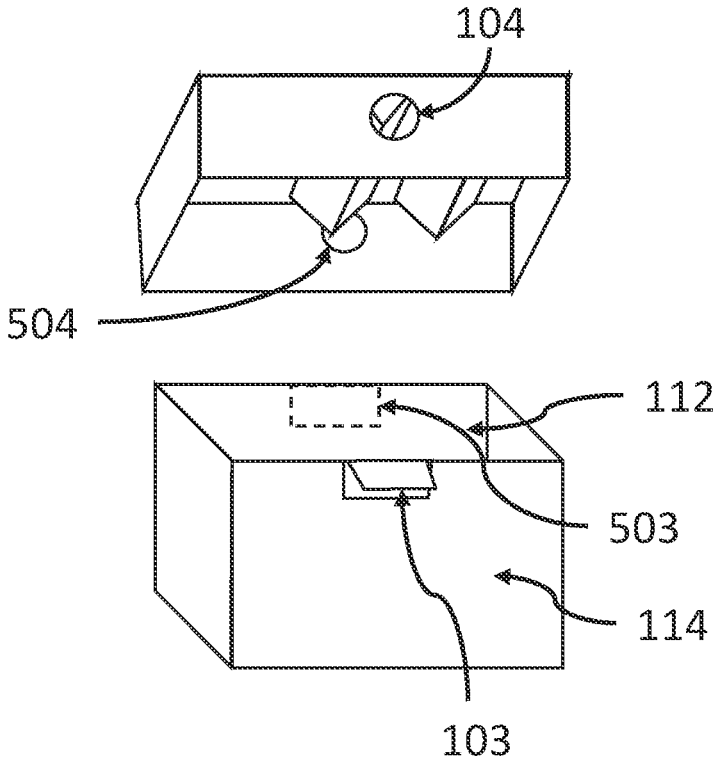
FIG. 5 illustrates a third example container.

FIGS. 4 and 5 illustrate examples similar to the example described in FIGS. 1 and 2 (the same reference numerals are used for common features), whereby the flanks cover one or more additional specific portions of sidewalls when the lid is in the closed position, the lock comprising one or more respective additional actuators 403 or 503, each moveable from a locking position to an opening position by simultaneously applying the actuation pressure onto each of the first actuator 103 and the one or more additional actuators 403 or 503 when the lid is in the closed position, the one or more additional actuators being respectively connected to the one or more additional specific portions of sidewall, the flanks of the lid comprising one or more additional tactile discontinuities 404 or 504, the one or more additional tactile discontinuities respectively facing the one or more additional actuators 403 or 503 when the lid is in the closed position, each additional tactile discontinuity permitting displacing the respective additional actuator from the locking position to the opening position by applying the actuation pressure at the additional tactile discontinuity when the lid is in the closed position, whereby at least part of each additional specific portion of sidewall comes into contact with at least part of either or both prisms as the actuation pressure is applied. Such use of multiple actuators may for example strengthen the lock, the different actuators being positioned for example by different fingers of a same hand, or by two different hands. While the configurations illustrated in FIGS. 4 and 5 illustrate a single additional actuator, further actuators may be provided, on a same sidewall (see for example FIG. 3G), on different side walls, or on both a same and different sidewalls (see FIG. 6B for example, explained in more details below).

Indeed, as represented for example in FIG. 4, at least one additional specific portion of sidewall and the first specific portion of sidewall may pertain to the same specific sidewall 114, whereby the at least one additional specific portion of sidewall and the first specific portion of sidewall are offset along a direction parallel to the top of the lid. And, as represented for example in FIG. 5 or 6B, at least one additional specific portion of sidewall and the first specific portion of sidewall pertain to opposite sidewalls 114 and 112.

One should note that the configuration of the first and the second prisms offset along a direction parallel to the top of the lid is particularly suited to a configuration whereby tactile discontinuities are also offset along a direction P parallel to the top of the lid. In some example the prism offset and positioning is similar to the tactile discontinuities offset and positioning along a direction parallel to the top of the lid. Such offset and positioning may be precisely determined based on the offset and positioning of the geometric center of respective prisms or tactile discontinuities in a plane parallel to the specific portion of sidewall. In some examples, the offset distance between a pair of prisms and a corresponding offset distance between a corresponding pair of offset tactile discontinuities is of less than 30% of the offset distance between the pair of prisms, preferably of less than 20%, more preferably of less than 10%. In some examples, the positioning of a pair of prisms and a positioning of a corresponding pair of offset tactile discontinuities is of less than 30% of a mid-point position, such mid-point position corresponding to a ration between a first distance and a second distance, whereby the first distance is a distance between a prism mid-point (mid-point between prism geometric centres) and a tactile discontinuity mid-point (mid-point between tactile discontinuities geometric centres), the second distance being the distance between the prisms geometric centres. In some preferred examples, the positioning of a pair of prisms and a positioning of a corresponding pair of offset tactile discontinuities is of less than 20%. In some more preferred examples, the positioning of a pair of prisms and a positioning of a corresponding pair of offset tactile discontinuities is of less than 10%.

In some examples, the offset between the first and the second prisms along a direction P parallel to the top of the lid may be measured by an offset distance separating the respective linear ridges. In some examples, the offset distance is of more than 1 cm. In some examples, the offset distance is of more than 2 cm. In some examples, the offset distance is of more than 3 cm. In some examples, the offset distance is of more than 4 cm. In some examples, the offset distance is of less than 10 cm. In some examples, the offset distance is of less than 9 cm. In some examples, the offset distance is of less than 8 cm. In some examples, the offset distance is of less than 7 cm. In some examples, the offset distance is between 2.5 cm and 7 cm.

Figure 6A:
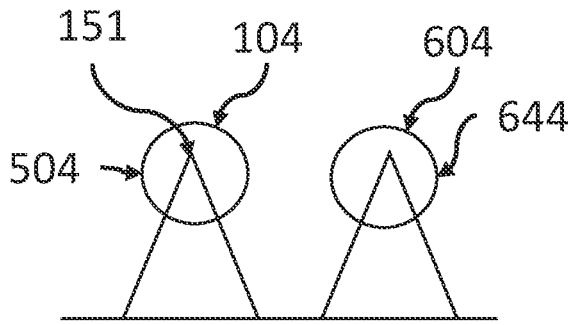
FIG. 6A-B illustrate a fourth example container.
Figure 6B:
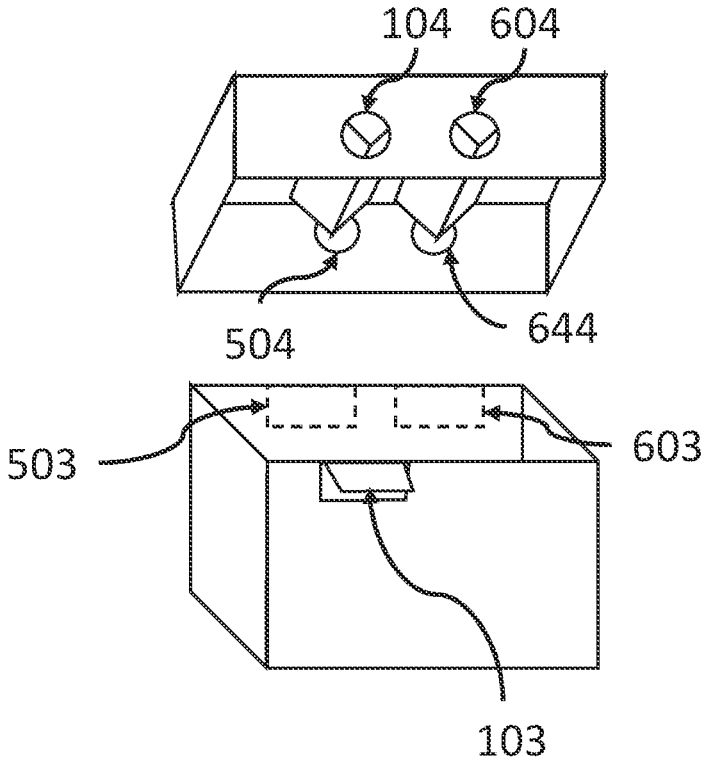

FIGS. 6A and 6B illustrate a further example configuration. Again, features already discussed in the context of other Figures either carry the same reference numeral, or are not numbered. In such a configuration, the flanks cover one or more further specific portions of sidewalls when the lid is in the closed position, the flanks of the lid comprising one or more further tactile discontinuities, in this case a single further tactile discontinuity 604, the one or more further tactile discontinuities respectively directly facing the further specific portions of sidewalls when the lid is in the closed position, whereby at least part of each further specific portion of sidewall comes into contact with at least part of either or both prisms, in this example with part of the second prism, as the actuation pressure is applied directly onto each further specific portion of sidewall.

In this example of FIGS. 6A and 6B (FIG. 6A using the figure format used for FIGS. 3A-H applied to the container of FIG. 6B), additional tactile discontinuities 504 and 644 are both placed on a same flank opposite to the flank carrying tactile discontinuity 104, additional tactile discontinuities 504 and 644 being offset by a distance parallel to the top of the lid, tactile discontinuity 104 facing tactile discontinuity 504, tactile discontinuity 644 facing further tactile discontinuity 604. While the first tactile discontinuity 104, as well as additional tactile discontinuities 504 and 644, permit manipulating the lock through respective first and additional actuators 103, 503 and 603, the further tactile discontinuity 604 directly faces the sidewalls of the box when the lid is in the closed position. Touching the further tactile discontinuity 604 will thereby have no direct impact on the lock, thereby permitting offering a point from which the container may be gripped without opening the lock. One should note that in the context of this disclosure, the wording "further discontinuity"/"further specific portion of sidewall" correspond to a tactile discontinuity which directly faces the sidewalls of the box and does not contribute to locking, whereas the wording "additional discontinuity"/"additional specific portion of sidewall"/"additional actuator" corresponds to a combination of features which does participate to the lock. It is sometimes desired to manipulate the container without opening the lock. In particular in cases of generally smooth sidewalls and of a generally smooth lid, whereby the only gripping points would be related to operating a lock, it could indeed be problematic to grip the container by such gripping points which could lead to an undesired container opening. This is avoided by providing a further tactile discontinuity on a flank of the lid. Such further tactile discontinuity may for example be used by machinery to manipulate the container on a factory line without opening the box. Such further tactile discontinuity may also be used by a user as a reference gripping point for actually opening the lock by also pressing onto the first and additional tactile discontinuities, when present, at the same time. The fact that the further tactile discontinuity directly faces a corresponding sidewall portion of the box indeed permits having a stable gripping point, unlike the structure corresponding to the first or additional tactile discontinuities which corresponds to the first or additional actuators which are movable between different positions. It was indeed found that having at least one finger placed in a stable location (i.e. at the further tactile discontinuity) was facilitating operating the first or additional actuators with a second or additional fingers, through a "lever" effect, the further tactile discontinuity acting as a stable base for this lever effect. "Directly facing" should be understood in that the lid, in the area of the further tactile discontinuity, is separated by the corresponding sidewall portion of the box only by a thin air clearance layer, the corresponding further sidewall portion being actuator-less or flap less in order to provide for the stability desired. In some examples, one or more further tactile discontinuities are provided in the lid, preferably on a flank of the lid, such one or more further tactile discontinuities being directly facing a corresponding further specific portion of sidewalls when the lid is in the closed position in order to provide for one or more stable additional gripping points. In some examples, at least one of such one or more further tactile discontinuities are located on a flank of the lid opposite to another flank on which a first or additional tactile discontinuity is located, such that an even more improved gripping may be provided, for example when such gripping is desired without risk of unlocking the container. In some examples, a lid as represented in FIG. 6B comprises 4 tactile discontinuities, being 2 on a first flank of the lid, 2 on a flank of the lid opposite to the first flank, a single one of such 4 discontinuities being a further tactile discontinuity 604, the other 3 tactile discontinuities 104, 504 and 644 being a first and additional tactile discontinuities each corresponding to a respective actuator 103, 503 and 603.

As illustrated for example in FIG. 6A, which corresponds to a schematic representation of the configuration of FIG. 6B similarly to the schematic representations 3A-H, at least part of the first specific portion of sidewall comes into contact with the first linear ridge 151 as the actuation pressure is applied. Indeed, in some examples, at least part of the first specific portion of sidewall comes into contact with the first or with the second linear ridge as the actuation pressure is applied. Such configurations can in some cases permit providing support while reducing a prism depth in relation to the top of the lid, in particular if the linear ridge is a linear ridge of the respective prism further away from the top of the lid.

FIGS. 7A-I schematically illustrate example support elements as cross sections along a plane normal to the linear ridges (or normal to the transverse direction T). Again, reference numerals used may correspond to reference numerals used in the context of other figures when the feature is a corresponding feature. In FIGS. 7A-I, reference numerals are not repeated Figure to Figure to increase readability.

Figure 7A:
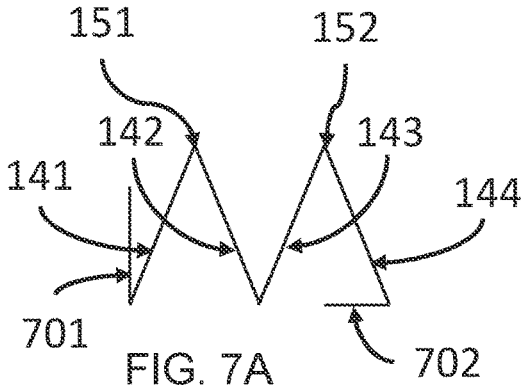
FIG. 7A-I illustrate different example support element configurations.

In the example illustrated in FIG. 7A, in addition to the first primary panel 141, second primary panel 142, third primary panel 143, fourth primary panel 144, first linear ridge 151 and second linear ridge 152, the support element further comprises a first flap 701 and a second flap 702. Such first and second flaps can permit connecting the support element to, for example the top of the lid in the case of the second flap 702 which is in a plane corresponding to the top of the lid, or connecting the support element to a lid flank such as first flap 701 which is extended in a direction normal to the top of the lid. In this and other examples, such connection of the support elements to a flank or top of the lid may be by glue or by staples, for example. In this example the first flap is connected to the first primary panel and the second flap to the fourth primary panel, whereby the first primary panel is connected to both the first flap and the second primary panel on opposite first primary panel sides, and whereby the fourth primary panel is connected to both the second flap and the third primary panel on opposite fourth primary panel sides.

Figure 7B:
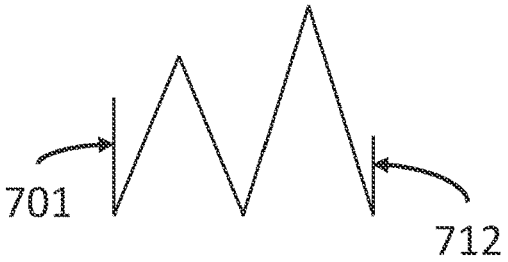

In the example of FIG. 7B, both the first flap 701 and the second flap 712 are in a plane perpendicular to the top of the lid, both being for example for connection of the support element to opposite flanks of the lid.

Figure 7C:
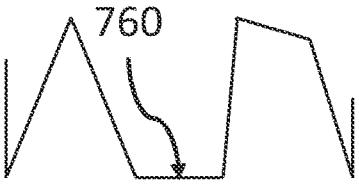

In the example of FIG. 7C, the first and second prisms are different, in this case a triangular prism and a four sided prism, both the first and the second flaps are in a plane perpendicular to the top of the lid, and the support element is provided with a transition panel 760, the transition panel connecting the second primary panel and the third primary panel, whereby the transition panel is connected to both the second primary panel and the third primary panels on opposite transition panel sides, whereby the transition panel is configured to be attached to the top of the lid, for example by glue or staples. Such a transition panel may for example be used in configurations represented in FIG. 3D, 3E, 3F, 3G, 3H, 5, 6A-B, 7E or 7H. In other examples such as illustrated in FIG. 7A, 7B, 7D, 7F, 7G, 3A, 3B or 3C, the second primary panel and the third primary panel are directly connected to each other instead of being indirectly connected through one or more transitional panels. In configurations whereby the second primary panel and the third primary panel are directly connected to each other, the line connecting the second and third primary panel may be glued or stapled to or onto the top of the lid to ensure connection with the top of the lid between the prisms.

Figure 7D:
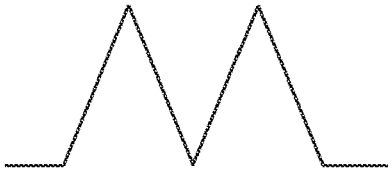
Figure 7E:
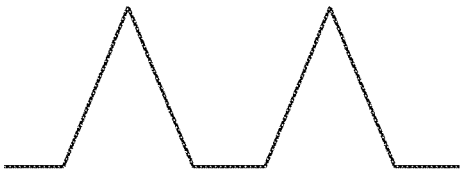

In the example of FIG. 7D, both the first and the second flaps are in the plane of the top of the lid, without transition panel. In the example of FIG. 7E, both the first and the second flaps are in the plane of top of the lid, with transition panel.

Figure 7F:
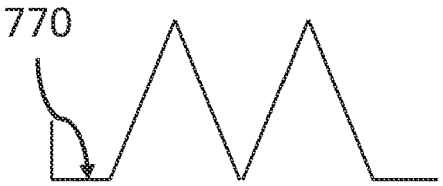
Figure 7G:
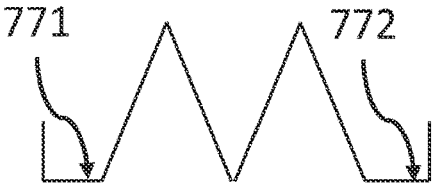
Figure 7H:
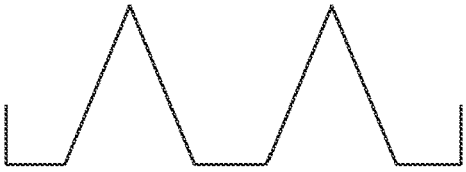

In the example of FIG. 7F, a secondary panel 770 is provided connecting the first flap to the first primary panel permitting customizing the positioning of the prisms in relation to the positioning of the first flap. In the examples of FIGS. 7G and 7H, secondary panels 771 and 772 are provided connecting both the first and the second flaps to the first and fourth primary panels respectively, thereby permitting positioning the prisms for example in a central region of the lid while contributing to reducing prism depth away from the top of the lid. Such configurations may be provided with (7H) or without (7G) transition panel. One should note that numerous other configurations may be proposed in order to customize support which are not illustrated here.

In FIG. 7G, the support element may be particularly robustly connected to the flanks of the lid through the flaps, and distance between prisms and flanks parallel to linear ridges may be customized through secondary panels, whereby the support element comprises:

- a first and a second flap extended in a direction normal to the top of the lid;
- a first secondary panel, the first secondary panel connecting the first flap and the first primary panel; and
- a second secondary panel, the second secondary panel connecting the second flap and the fourth primary panel.

Figure 7I:
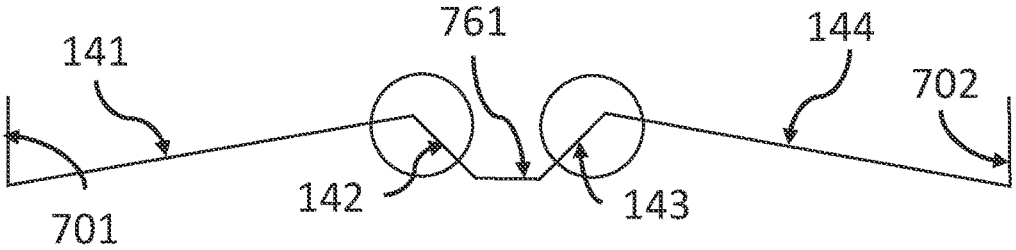

In FIG. 7I, the support element takes a so-called "gull-wings" configuration, whereby the first 701 and the second 702 flap are extended in a direction normal to the top of the lid, whereby the support element is provided with a transition panel 761, the transition panel connecting the second primary panel 142 and the third primary panel 143, whereby the transition panel is connected to both the second primary panel and the third primary panels on opposite transition panel sides, whereby the transition panel is configured to be attached to the top of the lid, for example by glue or staples, whereby the first primary panel is longer than the secondary panel along a direction perpendicular to the linear ridge, whereby the first primary panel is for example more than twice longer than the secondary panel along a direction perpendicular to the linear ridge, whereby the fourth primary panel is longer than the third panel along a direction perpendicular to the linear ridge, whereby the fourth primary panel is for example more than twice longer than the third panel along a direction perpendicular to the linear ridge. In some examples, the first (respectively fourth) primary panel is more than four times longer than the secondary (respectively third) panel along a direction perpendicular to the linear ridge and the first (respectively fourth) primary panel is less than five times shorter than the secondary (respectively third) panel along a direction perpendicular to the linear ridges. In some examples, the resulting "gull wing" configuration permits obtaining a desirable offset between the linear ridges to fit a desirable finger placement while limiting the number of panels and flaps forming the support element and offering support along a large proportion of the length of the container along a direction perpendicular to the linear ridges and parallel to the top of the lid.

In FIGS. 7C, 7E, 7H and 7I, the support element may be particularly robustly connected to the top of the lid through the transition panel, and distance between prisms may be customized through the same transition panel, whereby the support element further comprises the transition panel, the transition panel connecting the second primary panel and the third primary panel, whereby the transition panel is attached to the top of the lid.

In FIGS. 7A-I, the support element may be formed of cardboard corrugated fiber-board, the corrugated fiber-board comprises a series of flutes running parallel to one another along the direction of the linear ridges.

Figures 8A, 8B:
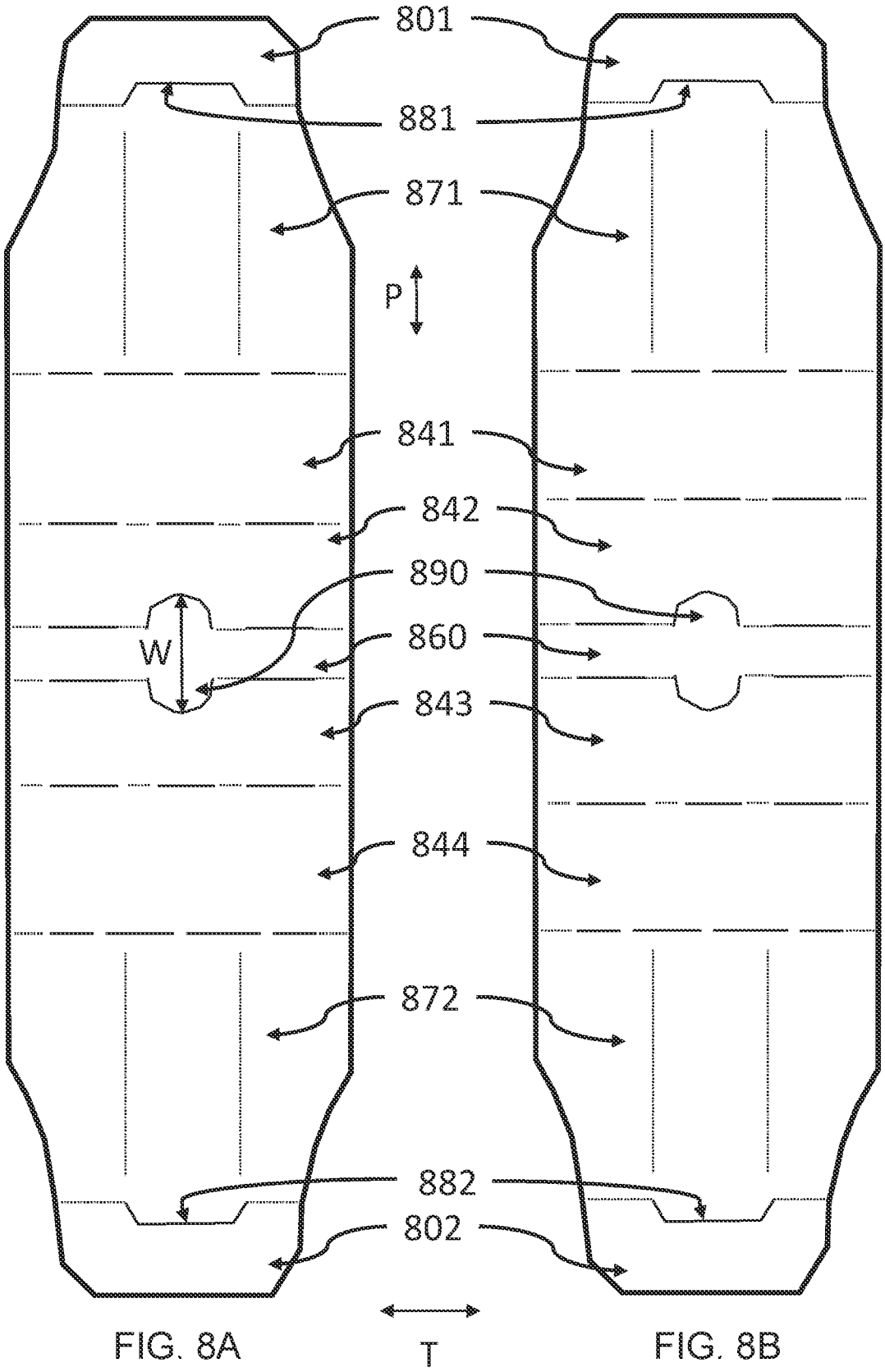
FIG. 8A-B illustrate different example support element blanks.

FIGS. 8A and 8B represent example support elements in a blank form. Both blanks comprise primary panels 841-844, a transition panel 860 connecting the second primary panel and the third primary panel and configured to be attached to the top of the lid, a first flap 801 configured to be attached to a first flank of a lid and a second flap 802 configured to be attached to a second flank of the lid, the second flank being opposed to the first flank, a first secondary panel 871, the first secondary panel connecting the first flap and the first primary panel, and a second secondary panel 872, the second secondary panel connecting the second flap and the fourth primary panel. The blank of FIG. 8A differs from the blank of FIG. 8B in that in the blank of FIG. 8A the second and third primary panels 842 and 843 have a same first size, and the first and fourth primary panels 841 and 844 have a same second size differing from the first size, whereas, in the blank of FIG. 8B, the primary panels 841-844 all have a same size. In both cases, the first flap, first secondary panel, first primary panel, second primary panel, transition panel, third primary panel, fourth primary panel, second secondary panel and second flap follow each other in this order along a longitudinal direction, each flap or panel being separated from the next by a fold line or folding region perpendicular to the longitudinal direction (i.e. a fold line or folding region parallel to the transverse direction T). It should be understood that a folding region is a region along which a panel or flap may be folded. In some examples, a folding region may comprise a single fold line, such fold line being thereby parallel to a linear ridge. In some examples, the folding region may comprise a plurality of fold lines, each fold line of the plurality being parallel to the linear ridge, whereby such a folding region may in some cases define a relatively "smooth" or "rounded" profile in a plane normal to the linear ridge The example support elements represented in FIGS. 8A and 8B are such that each secondary panel comprises a respective cutout 881 and 882 in a folding region between the respective secondary panel and the respective flap. Such cutout are configured such that each respective cutout may come into direct contact with a respective flank of the lid beyond and through the respective flap when the support element is erected, thereby contributing to erecting the prisms. Such cutouts remain aligned with the respective secondary panel as the support element is erected, the respective secondary panels being substantially at right angle to the respective flaps when the support element is erected. One should note that while illustrated in the context of FIGS. 8A and 8B, such cutouts may be provided in other configurations hereby described whereby the flaps are at an angle to the secondary panels when the lid is erected.

The example support elements represented in FIGS. 8A and 8B are also such that the transition panel comprises a cutout 890 for attachment to the top of the lid, the cutout increasing a width W of the transition panel along a direction perpendicular to the transverse direction T. Such a cutout of the transition panel may for example be used to apply glue, avoiding that the glue may extend beyond the cutout and into an adjacent primary panel 842 or 843 and prevent or impact prism erection. One should note that while illustrated in the context of FIGS. 8A and 8B, such a cutout may be provided in other configurations hereby described whereby the transition panel is configured to be attached to the top of the lid. One should note that other configurations may be considered to attach a transition panel to the top of the lid, for example by providing two or more cut-outs such as cutout 890 in order to provide multiple gluing or attachment zones and as such get a stronger attachment of the transition panel to the top of the lid. Alternatively or in combination, one may consider applying glue (or other fixing means) to areas within transition panel 860 beyond cutout 890, or to glue or fix the entire transition panel 860 and cut-out(s) 890 to the top of the lid.

In FIGS. 8A and 8B, adjacent flaps or panels are represented as being separated by fold lines parallel to transverse direction T, whereby such fold lines may comprise one or more cutouts represented by a thicker solid line parallel to transverse direction T, and/or thinner dotted lines also parallel to transverse direction T representing a line of weaknesses (i.e. not cutout). Thinner dotted lines perpendicular to transverse direction T represent reinforcement lines for reinforcement of the secondary panels in order to contribute to maintaining such secondary panels flat.

Figure 9A:
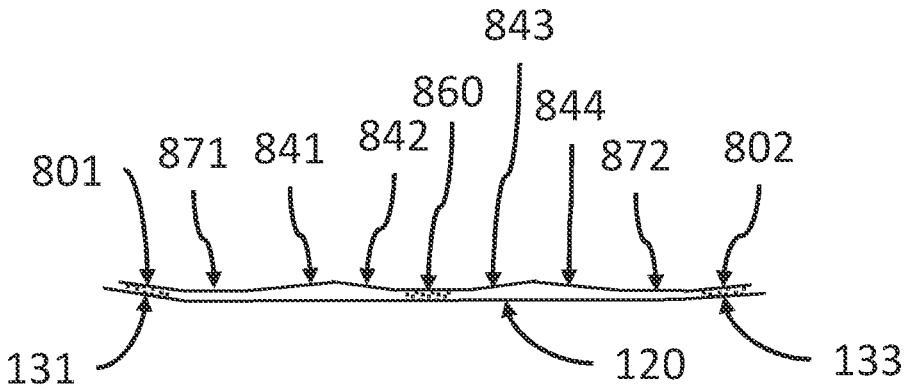
FIG. 9A-C illustrate different example methods.
Figure 9B:
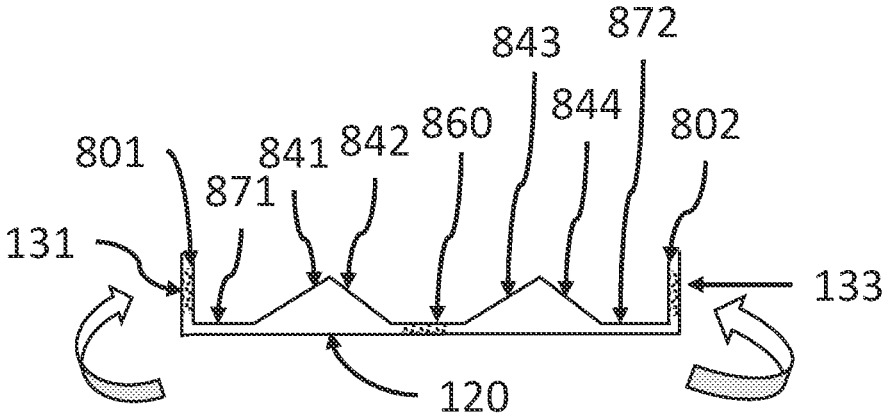
Figure 9C:
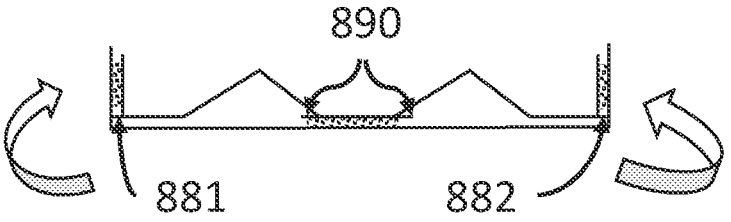

FIGS. 9A, 9B and 9C illustrate example methods to manufacture a container as per examples hereby described, in particular in cases whereby flaps are provided to be attached to opposite flanks, and whereby a transitional panel is provided to be attached to the top of the lid, corresponding for example to examples illustrated in FIG. 7C, 7G, 7H, 8A or 8B.

In FIG. 9A, an example lid is represented in cross section in a blank form, such example lid comprising opposite flanks 131 and 133, a top 120 of the lid, such top and opposite flanks being substantially in a same plane, the lid further comprising primary panels 841-844, a transition panel 860 connecting the second primary panel and the third primary panel and configured to be attached to the top of the lid, a first flap 801 configured to be attached to the flank 131 of a lid and a second flap 802 configured to be attached to the flank 133 of the lid, the second flank being opposed to the first flank, a first secondary panel 871, the first secondary panel connecting the first flap and the first primary panel, and a second secondary panel 872 connecting the second flap and the fourth primary panel, whereby panels and flaps 801, 871, 841, 842, 860, 843, 844, 872 and 802 are substantially aligned with each other and facing the opposite flanks 131, 133, and top 120 of the lid. One should note that further panels may be provided between some of such panels and flaps. One should also note that combining, on one hand, the flanks and top of the lid 131, 120 and 133 and, on the other hand, the structure comprising elements 801, 871, 841, 842, 860, 843, 844, 872 and 802 superposed in a flat structure permits that the flattened prisms may be attached to the flat lid structure 131, 120, 133 at a carton convertor facility to enable efficient manufacturing and flat shipping of complete lid blanks to the a forming and filling location where the lid is formed and the prism self erects in the desired 3D shape. As illustrated in FIG. 9A, the example method comprises attaching the first and the second flaps to opposite flanks and attaching the transition panel to the top of the lid, for example using glue represented by dotted areas (staples or other attachment means may also be used instead of or in combination with glue). Such attaching takes in this example place prior to erecting the lid as represented in FIG. 9B or 9C, whereby the prisms get erected by folding of the opposite flanks in a direction perpendicular to the top of the lid, the secondary panels sliding flush against the top of the lid as the prisms get erected. "Flush" should be understood as zero or low angle, for example at an angle of less than 15 degrees, preferably less than 10 degrees, more preferably less than 5 degrees between the top of the lid and a secondary panel. FIG. 9C represents an example whereby the transition panel comprises a cutout 890 for attachment to the top of the lid and each secondary panel comprises a respective cutout 881 and 882 in a folding region between the respective secondary panel and the respective flap, each respective cutout coming into direct contact with a respective flank of the lid beyond and through the respective flap, for example using a blank such as represented in FIG. 8A or 8B. FIG. 9B represents an example without such cutouts.

In some examples not represented here, the lid may be further reinforced through reinforced corners as described for example in co-pending application EP22214415.6.

The container may be made from rigid paperboard or cardboard material, flexible paperboard or cardboard material or a mixture thereof. In some example, the layer material forming the box or the lid has a wall thickness of more than 300 microns and of less than 6 mm per layer. In some example, the layer material forming the box or the lid has a wall thickness of more than 1 mm and of less than 2 mm per layer. The container may be made from paper materials, bio based material, bamboo fibres, cellulose fibres, cellulose based or fibre based materials, or a mixture thereof. The container may be made from materials comprising recycled materials, for example recycled cellulose fiber based materials. In some examples, the container is made from C (3.2 mm) flute corrugated cardboard. In some examples, the container is made from double wall cardboard, in some example made from double wall cardboard up to 5 mm thick per double wall layer.

In some examples the flanks of the lid cover about 30% of the sidewalls of the box, 30% corresponding in this case to a ratio between on one hand a height of the flanks in a direction normal to both the top of the lid and the base of the box and on the other hand the height of the sidewalls in the direction normal to both the top of the lid and the base of the box. In an example, the flanks completely surround the sidewalls around the opening. Such coverage of the flanks participates in ensuring lid placement, structural resiliency and protection of the content. In some examples, the flanks cover at least 50% of the sidewalls when the lid is in the closed position. In some examples, the flanks cover at least 75% of the sidewalls when the lid is in the closed position. In some examples, the flanks cover at least 90% of the sidewalls when the lid is in the closed position. In some examples, the flanks cover 100% of the sidewalls when the lid is in the closed position. Increasing flank coverage increases robustness. In some examples, the flanks cover at most 90% of the sidewalls when the lid is in the closed position. In some examples, the flanks cover at most 80% of the sidewalls when the lid is in the closed position. In some examples, the flanks cover at most 70% of the sidewalls when the lid is in the closed position. Decreasing flank coverage can ease opening of the container by providing grip surface on both the lid and the box sidewalls. In some examples, a manufacturing process comprises providing different box sizes, for example boxes having a sidewall height of either 10 cm, 11.5 cm, 13.5 cm or 16 cm, whereby each box may be provided with a same lid fitting all box sizes provided, such as a lid having a flank height of 7 cm. In some examples, flank height is of more than 3 cm. In some examples, flank height is of more than 5 cm. In some examples, flank height is of more than 6 cm. In some examples, flank height is of 9 cm or more. In some examples, flank height is of 12 cm or more. In some examples, sidewalls of the box have a sidewall height along a direction perpendicular to the base of 30 cm or more. In some examples, sidewalls of the box have a sidewall height along a direction perpendicular to the base of up to 40 cm.

In some examples, the primary panels have a width along the transverse direction of less than 12 cm, preferably less than 11 cm, more preferably less than 10 cm and even more preferably less than 8.5 cm. In some examples, the primary panels have a width along the transverse direction of more than 5 cm, preferably more than 6, more preferably more than 7 cm and even more preferably more than 7.5 cm. In some examples, the primary panels have a length along a direction perpendicular to the transverse direction of less than 6 cm, preferably less than 5 cm, more preferably less than 4.5 cm and even more preferably less than 4 cm. In some examples, the primary panels have a length along a direction perpendicular to the transverse direction of more than 1 cm, preferably more than 1.5, more preferably more than 1.75 cm and even more preferably more than 2 cm.

In some examples, a depth which the support element would reach within the box when the lid is closed is of less than 4 cm, preferably of less than 3 cm, more preferably of less than 2 cm and even more preferably of less than 1.5 cm. In some examples, a depth which the support element would reach within the box when the lid is closed is of more than 0.5 cm, preferably of more than 0.75 cm, more preferably of more than 1 cm.

The present disclosure further provides a consumer product comprising a detergent product and a container according to any of examples hereby described, whereby the box comprises the detergent product.

A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be designed taking on the shelf storage in a retail store into account. Consumer products should also be designed taking transportation from a retail store to a consumer home into account. Consumer products should also be designed taking storage at a private end consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. In some examples, the detergent product comprises unit dose detergent pouches, preferably water soluble unit dose detergent pouches, more preferably flexible water soluble unit dose detergent pouches. Example unit dose detergent pouches are described in more detail herein. Providing a compact and efficient support element as described hereby is particularly suited to such a consumer product, avoiding or reducing the likely hood that the support element would be pressed onto the content when pushing the lid down to close the box, avoiding or reducing pouch breakage.

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol homopolymer or polyvinyl alcohol copolymer, for example a blend of polyvinylalcohol homopolymers and/or polyvinylalcohol copolymers, for example wherein the polyvinyl alcohol copolymers are selected from sulphonated and carboxylated anionic polyvinylalcohol copolymers especially carboxylated anionic polyvinylalcohol copolymers, for example the water-soluble comprises a blend of a polyvinylalcohol homopolymer and a carboxylated anionic polyvinylalcohol copolymer, or alternatively a blend of polyvinyl alcohol homopolymers. Alternatively the polyvinyl alcohol in the water-soluble film consists of an anionic polyvinylalcohol copolymer, especially a carboxylated polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cardboard or paperboard container comprising a box, a lid for the box, and a lock to maintain the lid in a closed position, the box comprising a base, sidewalls and an opening, the lid comprising a top and flanks, the top covering the opening and the flanks covering at least a first specific portion of sidewall of the box when the lid is in the closed position, the lock comprising at least a first actuator moveable from a locking position to an opening position by applying an actuation pressure onto the first actuator when the lid is in the closed position, the first actuator being connected to the first specific portion of sidewall, the flanks of the lid comprising a first tactile discontinuity, the first tactile discontinuity facing the first actuator when the lid is in the closed position, the first tactile discontinuity permitting displacing the first actuator from the locking position to the opening position by applying the actuation pressure at the first tactile discontinuity when the lid is in the closed position, whereby the first specific portion of sidewall and the first actuator pertain to a same specific sidewall, whereby the lid further comprises a support element fitting within the box when the lid is in a closed position, the support element comprising:

a first primary panel and a second primary panel connected by a first linear ridge parallel to a transverse direction normal to the specific side wall, the first primary panel and the second primary panel corresponding to faces of a first prism connected to the top of the lid, the first linear ridge corresponding to an edge of the first prism; and a third primary panel and a fourth primary panel connected by a second linear ridge parallel to the transverse direction, the third primary panel and the fourth primary panel corresponding to faces of a second prism connected to the top of the lid, the second linear ridge corresponding to an edge of the second prism;

whereby the first and the second prisms are offset along a direction parallel to the top of the lid and perpendicular to the linear ridges, the prisms each having a length along the transverse direction such that at least part of the first specific portion of sidewall comes into contact with at least part of both prisms as the actuation pressure is applied.

2. The container according to claim 1, whereby the flanks cover one or more additional specific portions of sidewalls when the lid is in the closed position, the lock comprising one or more respective additional actuators each moveable from a locking position to an opening position by simultaneously applying the actuation pressure onto each of the first and the one or more additional actuators when the lid is in the closed position, the one or more additional actuators being respectively connected to the one or more additional specific portions of sidewall, the flanks of the lid comprising one or more additional tactile discontinuities, the one or more additional tactile discontinuities respectively facing the one or more additional actuators when the lid is in the closed position, each additional tactile discontinuity permitting displacing the respective additional actuator from the locking position to the opening position by applying the actuation pressure at the additional tactile discontinuity when the lid is in the closed position, whereby at least part of each additional specific portion of sidewall comes into contact with at least part of either or both prisms as the actuation pressure is applied.

3. The container according to claim 1, whereby the flanks cover one or more additional specific portions of sidewalls when the lid is in the closed position, whereby at least one additional specific portion of sidewall and the first specific portion of sidewall pertain to the same specific sidewall, whereby the at least one additional specific portion of sidewall and the first specific portion of sidewall are offset along a direction parallel to the top of the lid and perpendicular to the linear ridges.

4. The container according to claim 1, whereby the flanks cover one or more additional specific portions of sidewalls when the lid is in the closed position, whereby at least one additional specific portion of sidewall and the first specific portion of sidewall pertain to opposite sidewalls.

5. The container according to claim 1, whereby the flanks cover one or more further specific portions of sidewalls when the lid is in the closed position, the flanks of the lid comprising one or more further tactile discontinuities, the one or more further tactile discontinuities respectively directly facing the further specific portions of sidewalls when the lid is in the closed position, whereby at least part of each further specific portion of sidewall comes into contact with at least part of either or both prisms as the actuation pressure is applied directly onto each further specific portion of sidewall.

6. The container according to claim 1, whereby the lid is symmetrical, whereby a plane of symmetry of the lid is perpendicular to the top of the lid and perpendicular to the first specific portion of sidewall.

7. The container according to claim 1, whereby the primary panels have a same size.

8. The container according to claim 1, whereby the second and third primary panels have a same first size, and whereby the first and fourth primary panels have a same second size differing from the first size.

9. The container according to claim 1, whereby at least part of the first specific portion of sidewall comes into contact with the first or with the second linear ridge as the actuation pressure is applied.

10. The container according to claim 1, whereby the support element further comprises:

a first and a second flap extended in a direction normal to the top of the lid.

11. The container according to claim 10, whereby each secondary panel comprises a respective cutout in a folding region between the respective secondary panel and the respective flap, each respective cutout coming into direct contact with a respective flank of the lid beyond and through the respective flap.

12. The container according to claim 10, whereby the support element further comprises a transition panel, the transition panel connecting the second primary panel and the third primary panel, whereby the transition panel is attached to the top of the lid.

13. The container according to claim 10, whereby the support element further comprises a transition panel, whereby the transition panel comprises a cutout for attachment to the top of the lid, the cutout increasing a width of the transition panel along a direction perpendicular to the transverse direction.

14. The container according to claim 10, whereby the support element further comprises:

a first secondary panel, the first secondary panel connecting the first flap and the first primary panel; and a second secondary panel, the second secondary panel connecting the second flap and the fourth primary panel.

15. A method to manufacture a container according to claim 10, the method comprising attaching the first and the second flaps to opposite flanks and attaching the transition panel to the top of the lid prior to erecting the lid.

16. A consumer product comprising a detergent product and a container according to claim 1, whereby the box contains the detergent product.

* * * * *